US008141299B2

(12) United States Patent
Vetter

(10) Patent No.: US 8,141,299 B2
(45) Date of Patent: Mar. 27, 2012

(54) NEGATIVE LOADING SNUBBER FOR CASEMENT WINDOW

(75) Inventor: Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 745 days.

(21) Appl. No.: 12/194,394

(22) Filed: Aug. 19, 2008

(65) Prior Publication Data

US 2010/0043299 A1 Feb. 25, 2010

(51) Int. Cl.
*E06B 7/16* (2006.01)

(52) U.S. Cl. ..... 49/483.1; 49/394; 16/86 B

(58) Field of Classification Search ..... 49/394, 49/483.1; 16/DIG. 6, 86 B, 86 R, 86 A
See application file for complete search history.

(56) References Cited

U.S. PATENT DOCUMENTS

| | | | | |
|---|---|---|---|---|
| 1,859,491 | A * | 5/1932 | Baer | 49/182 |
| 3,634,962 | A * | 1/1972 | Peterson | 49/383 |
| 4,392,330 | A | 7/1983 | Buhr | |
| 4,679,352 | A | 7/1987 | Bates | |
| 4,683,676 | A | 8/1987 | Sterner, Jr. | |
| 4,887,392 | A | 12/1989 | Lense | |
| 5,295,326 | A * | 3/1994 | Dickey | 49/482.1 |
| 5,356,185 | A | 10/1994 | Cameron | |
| 5,590,491 | A | 1/1997 | Piltingsrud | |
| 5,742,978 | A | 4/1998 | Vetter | |
| 5,813,171 | A | 9/1998 | Piltingsrud | |
| 6,311,439 | B1 | 11/2001 | Arcati et al. | |
| 6,363,659 | B1 | 4/2002 | Wang | |
| 6,588,154 | B1 | 7/2003 | Miller et al. | |
| 6,837,004 | B2 | 1/2005 | Annes | |
| 2005/0155301 | A1 | 7/2005 | Hapka et al. | |
| 2005/0166496 | A1 | 8/2005 | Farag | |
| 2008/0000164 | A1 | 1/2008 | Erickson et al. | |
| 2008/0005972 | A1 | 1/2008 | Cloutier et al. | |

OTHER PUBLICATIONS

Pages from Pamphlet entitled "99 Snubbers", pp. 1.7 and1.7a, © 1993. Published by Truth Hardware.
Pages from Pamphlet entitled "99 Snubbers", pp. 9 and 9a, Published by Truth Hardware.

* cited by examiner

*Primary Examiner* — Jerry Redman
(74) *Attorney, Agent, or Firm* — Patterson Thuente Christensen Pedersen, P.A.

(57) ABSTRACT

A casement window with a snubber assembly for maintaining the position of the window sash in the frame. The snubber assembly includes a pair of snubbers. Each snubber has a base portion and a hook-shaped flange extending from the base portion. One of the pair of snubbers is mounted to the frame and the other is mounted to the sash. The snubbers may be disposed such that when the sash is in the closed position, a contact surface of each snubber engages an interface surface of the other snubber. The hook-shaped flanges of the snubbers are adapted for releasable engagement when negative pressure is applied to the window sash.

9 Claims, 14 Drawing Sheets

NEGATIVE LOADING SNUBBER FOR CASEMENT WINDOW

FIELD OF THE INVENTION

The present invention relates generally to snubbers, and more particularly to snubbers for casement windows.

BACKGROUND OF THE INVENTION

Casement window assemblies are generally well known in the art. A casement window typically includes a window sash having a glass assembly surrounded by wood, vinyl or metal structure disposed in a frame with a central opening. Operable casement windows typically have the sash hinged at one side between an upper and lower hinge assembly. These assemblies enable the window to pivot between them at one side so the window may swing outward from the frame. An operator mechanism is usually attached to the lower hinge for selectively opening and closing the window sash. Casement windows are frequently used in all manner of installation locations due to their convenience, ease of use, and relative airtightness compared with sliding window designs.

Over the years, the market has demanded continually increasing window performance, including reduced window air infiltration. Typically, casement windows are designed with a stop frame structure disposed inward of the sash, against which the sash seals when the window is closed. Windows on the downwind side of a structure are subjected to negative pressure—that is, the pressure outside the structure is less than the pressure inside the structure, tending to draw the sash away from the stop frame against which it is sealed. A locking mechanism present along the lateral edge of the sash and the hinges at the top and bottom of the sash are relied upon to hold the sash in place. On the pivoting edge of the window opposite the locking mechanism edge, hardware known as snubbers are used to retain and stabilize the sash against negative pressure. One example of such negative pressure window snubber is disclosed in U.S. Pat. No. 5,742,978.

Snubbers generally function in one of two different ways: (1) a "compression snubber" causes the weatherstripping to be compressed by a desired amount and holds the sash in an optimum position against the weatherstripping to assure a sealed window; or (2) an "interlocking snubber" has features (generally hooks) that engage when the sash is exposed to high negative air pressure and prevent the snubbers from sliding past each other as the sash bows outward. A drawback of past interlocking snubber designs, however, is that there is significant clearance between the snubber components when the window is in the closed position in order to avoid interference when the window is operated. Hence, while they are generally effective for preventing excessive bowing of the sash under high negative pressure, this type of snubber does not provide the sealing performance of a compression snubber. Consequently, a higher than desired amount of air infiltrate through the assembly when the window is in its closed position.

What is needed in the industry is a window assembly having improved integrity and design capabilities when the sash is subjected to negative pressure and which provides a tighter seal between the seal and frame to inhibit air infiltration.

SUMMARY OF THE INVENTION

A casement window according to embodiments of the present invention addresses the above-mentioned needs with window hardware providing compression scaling functionality when the window is closed as well as interlocking functionally to limit excessive sash deflection in high negative pressure conditions. One embodiment of the present disclosure is directed to a negative pressure window snubber assembly for maintaining the position of a window sash. The snubber assembly includes a pair of snubbers where each snubber has a hook-shaped flange, at least one mounting aperture, and a slot aperture. The slot aperture receives the hook-shaped flange of the other snubber when the snubbers are in the normal mounting position. One snubber member is mounted to the window frame and one snubber is mounted to the window sash. The hook-shaped flanges of the snubbers are adapted for releasable engagement with one another when negative pressure is experienced by the window sash.

In another aspect, embodiments of the present disclosure are directed to a window snubber that includes a first snubber member with a rigid base and a flange. The base has features for attachment to a window frame and a slot for accommodating another snubber member. The flange is integrally formed with the rigid base and extends substantially upright from the base before terminating in a hooked end. The embodiment further includes a second snubber member including a rigid base and a flange. Likewise, the base has features for attachment to a window sash and a slot aperture for accommodating another snubber member. The flange is integrally formed with the rigid base and extends substantially upright from the base before terminating in a hooked end. Additionally, first and second snubber members are adapted to engage the hooked ends of the flanges with one another in a first position or to place each hooked flange in the slot aperture of the other snubber member in a second position.

In yet another aspect, embodiments of the present disclosure are directed to a window snubber assembly for maintaining the position of a window sash. This snubber assembly includes a base containing at least one mounting aperture and a slot aperture. The snubber assembly also includes a flange member protruding from and integral with the base that defines a hook profile at its end. The base and flange are shaped so that a similar snubber adjacently mounted is able to engage with it. In closed position, the flange is placed in the slot aperture. In another position, the flange member is able to engage the flange member of the similar snubber.

Generally, embodiments of the present disclosure are directed to an assembly for accommodating negative pressure conditions with a casement window. A first negative pressure snubber is mounted along a frame member and a second negative pressure snubber is mounted along a sash. When the sash is exposed to negative pressure, and is urged outwardly, the first and second negative pressure snubbers exert pressure against one another at their engaged abutting locations to inhibit further movement of the sash assembly. The snubbers are applied to sash and frame sections at points of high deflection to maintain seal contact when negative air pressures are encountered. The snubbers are also shaped such that the flanges provide engaged seal contact when negative air pressure is not encountered.

In an embodiment, a casement window includes a frame defining an opening and a sash operably coupled with and disposed in the frame. The sash is selectively positionable between a closed position in which the sash closes the opening defined by the frame and an open position. The window further includes a snubber assembly for maintaining the position of the window sash in the frame, the snubber assembly including a pair of snubbers. Each snubber has a base portion and a hook-shaped flange extending from the base portion.

The base presents an interface surface and the flange presents a contact surface. One of the pair of snubbers is mounted to the frame and the other of the pair of snubbers is mounted to the sash, and the snubbers are disposed such that when the sash is in the closed position, the contact surface of hook-shaped flange of each snubber engages the interface surface of the other snubber. The hook-shaped flanges of the snubbers are adapted for releasable engagement when negative pressure is applied to the window sash.

In an embodiment, the contact surface of the flange of each snubber may be generally parallel with the interface surface of the snubber. In a further embodiment, the base defines a slot aperture, and wherein the interface surface faces into the slot aperture. In another embodiment, the base defines a notch in a periphery thereof, and the interface surface faces into the notch. In a further embodiment, the base defines a recess therein, and the interface surface faces into the recess.

In an embodiment, a window snubber assembly for maintaining the position of a window sash in a window frame includes a first snubber member including a base and a flange portion, the base having features for attachment to a window frame and a slot for receiving the flange portion of another snubber member, the flange portion integral with the base and extending substantially upright from the base, the flange portion terminating in a hooked end presenting a contact surface, the base presenting an interface surface facing into the slot. A second snubber member includes a base and a flange portion, the base having features for attachment to a window sash and a slot for receiving the flange portion of another snubber member, the flange portion integral with the base and extending substantially upright from the base, the flange portion terminating in a hooked end presenting a contact surface, the base presenting an interface surface facing into the slot. The contact surface of the first snubber engages the interface surface of the second snubber when the flange portion of the first snubber is received in the slot of the second snubber, wherein the contact surface of the second snubber engages the interface surface of the first snubber when the flange portion of the second snubber is received in the slot of the first snubber. The hooked end portions of the flange portions of the first and second snubbers are cooperatively shaped so as to enable hooked engagement of the first and second snubbers.

In another embodiment, a method of reducing air infiltration through a casement window under negative pressure is disclosed. The window includes a frame presenting a weather strip and a sash disposed in the frame and sealingly engaged with the weather strip. The method includes providing a snubber assembly comprising a pair of snubbers, each snubber having a base portion and a hook-shaped flange extending from the base portion, the base presenting an interface surface and the flange presenting a contact surface, and mounting one of the pair of snubbers to the frame and the other of the pair of snubbers to the sash, the snubbers disposed such that the contact surface of the hook-shaped flange of each snubber engages the interface surface of the other snubber, the engagement of the snubbers functioning to bias the sash onto the weather strip on the frame.

In a further embodiment, a casement window includes a frame including a stop member and weatherstripping on the stop member, a sash assembly disposed in the frame and sealingly engaged with the weatherstripping, and means for biasing the sash assembly in sealing contact with the weatherstripping and means for inhibiting excessive deflection of the sash away from the frame when air pressure is applied to the sash. The means for biasing the sash assembly in sealing contact with the weatherstripping may include a pair of snubbers, each snubber presenting an interface surface and a contact surface, wherein one of the pair of snubbers is mounted to the frame and the other of the pair of snubbers is mounted to the sash, the snubbers disposed such that the contact surface of each snubber engages the interface surface of the other snubber. In embodiments of the invention, each snubber includes a base and a flange portion extending from the base. In certain embodiments of the invention, the contact surface is presented by the flange and the interface surface is presented by the base. In certain embodiments, the base defines a slot aperture, and wherein the interface surface faces into the slot aperture. In certain other embodiments, the base defines a notch in a periphery thereof, and wherein the interface surface faces into the notch. In certain other embodiments, the base defines a recess therein, and wherein the interface surface faces into the recess. In embodiments of the invention, the means for inhibiting excessive deflection of the sash away from the frame when air pressure is applied to the sash includes a pair of snubbers, wherein one of the pair of snubbers is mounted to the frame and the other of the pair of snubbers is mounted to the sash, each of the snubbers including a flange with a hooked end portion, the hooked end portions of the snubbers cooperatively shaped so as to enable hooked engagement of the snubbers with each other.

It is an object of certain embodiments the present invention to inhibit deflection of casement window sashes and improve the seals of the sash with the frame when in the closed position. Furthermore, it is an object of certain embodiments of the invention to increase weather seal effectiveness by maintaining seal contact, especially on large sash sizes.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
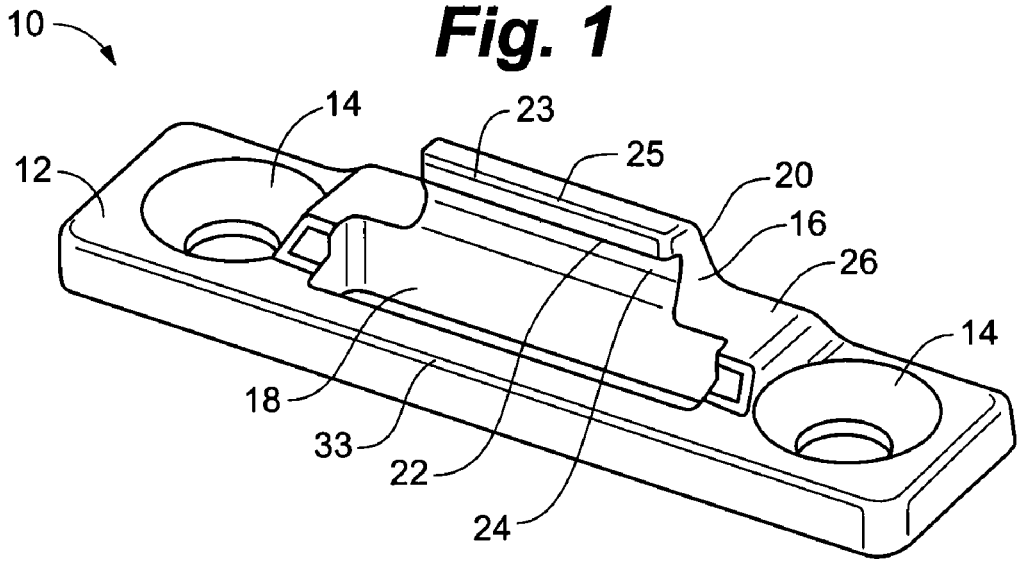
FIG. 1 is a perspective view of an embodiment of a snubber device of the present disclosure.
Figure 2:
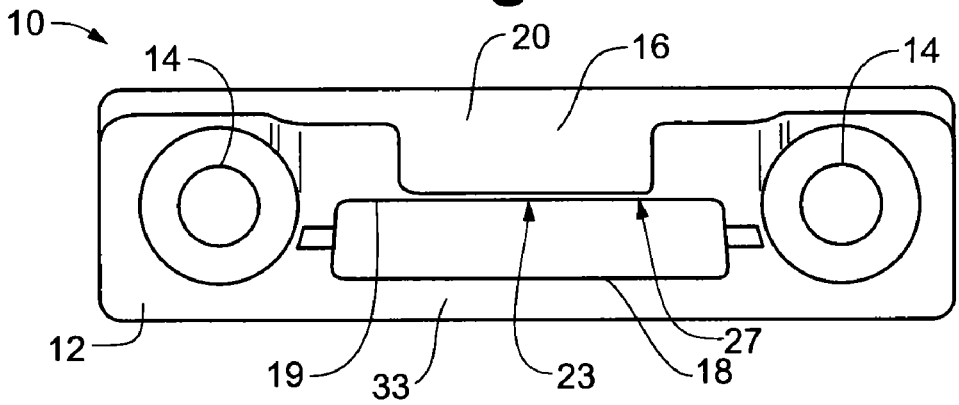
FIG. 2 is a top view of an embodiment of the snubber device of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE PREFERRED EMBODIMENTS

Figure 1A:
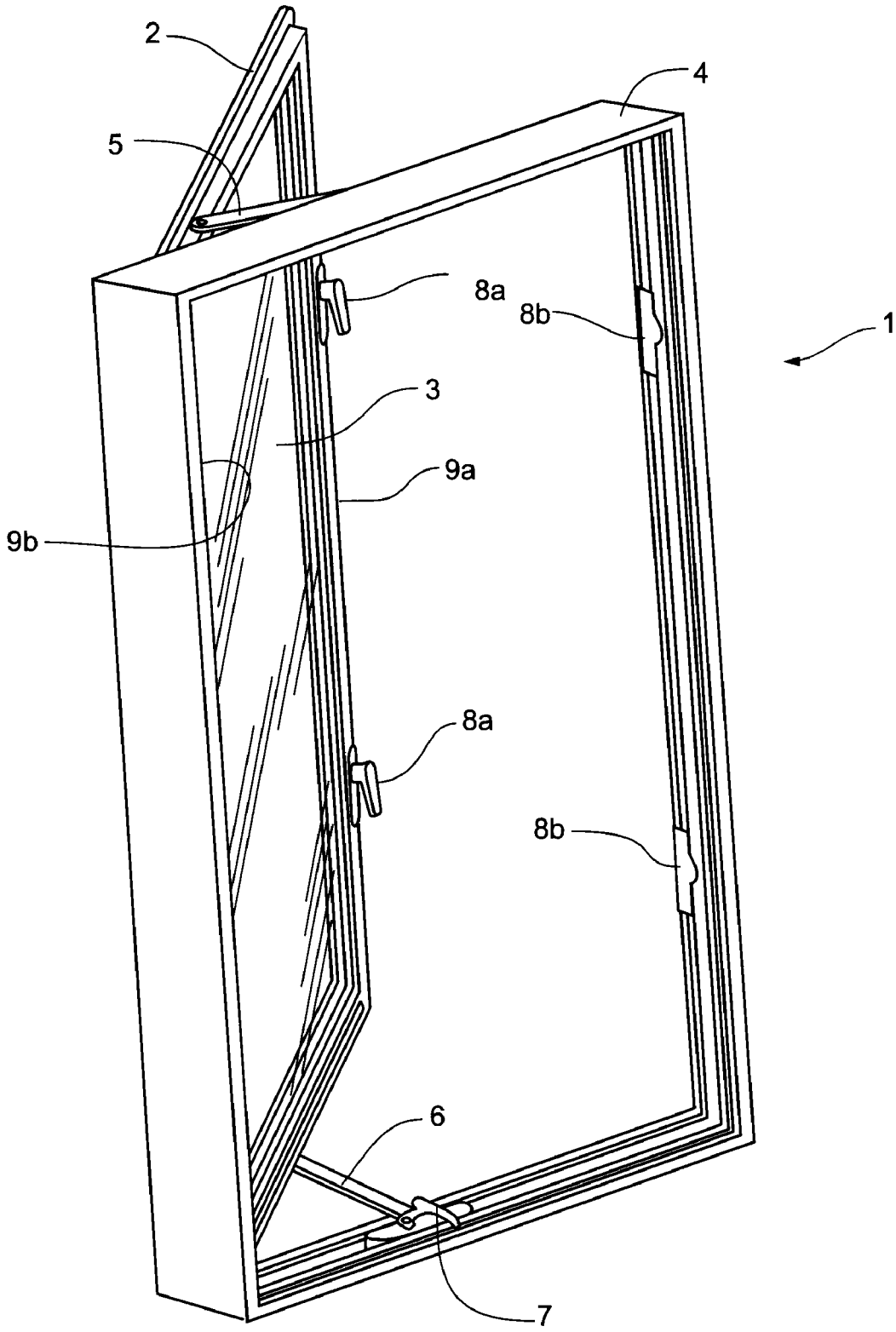
FIG. 1*a* is a perspective view depicting the general features and structure of a casement window.
Figure 3:
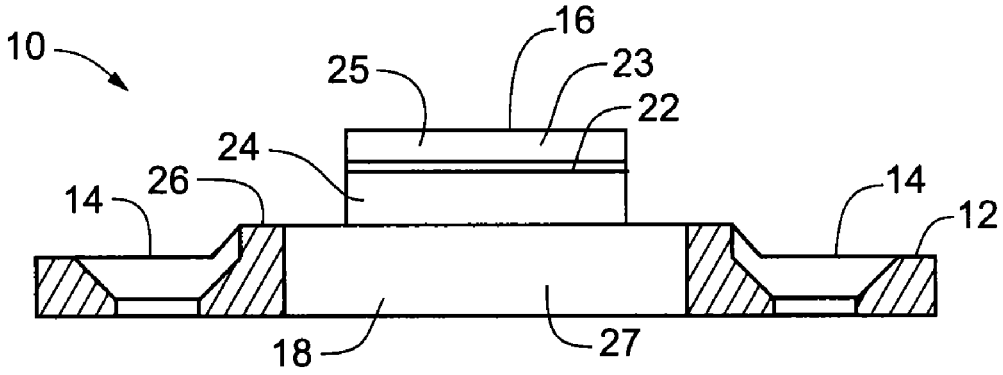
FIG. 3 is a front cross-sectional view of the snubber device of FIG. 1.
Figure 4:
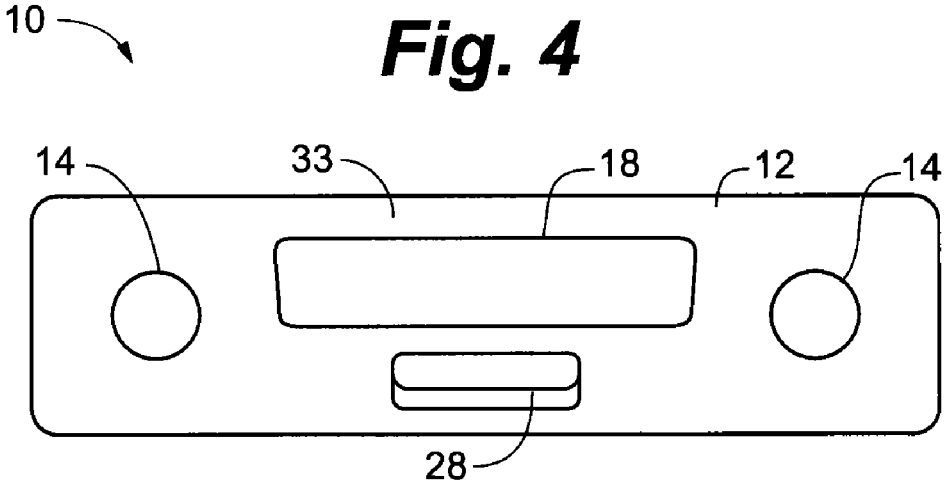
FIG. 4 is a bottom view of the snubber device of FIG. 1.

FIG. 1*a* depicts casement window 1 according to an embodiment of the invention. Casement window 1 generally includes sash 2 with glass assembly 3 and frame 4. Sash 2 is operably coupled to frame 4 with upper hinge assembly 5 and lower hinge assembly 6 so as to enable sash 2 to swing open and closed to selectively close the opening defined by frame 4 as desired with a crank or operator mechanism 7. Locking mechanism 8*a* and corresponding latches 8*b* can be seen along one edge 9*a* of the window. In some casement windows, the opposite pivoting edge 9*b* of the window is equipped with snubbers, as in the present disclosure.

In FIGS. 1-5, a window snubber 10 according to an embodiment of the present invention is depicted. Snubber 10 has base 12 which includes features permitting attachment of snubber 10 to sash 2 or frame 4. In a preferred form of the invention, snubber 10 is attached to to sash 2 or frame 4 by fasteners (not depicted) extending through apertures 14 formed at opposite ends of base 12. The mounting of such a window snubber by screws is well known in the art, however, the present invention is not limited solely to mounting via screws.

It should be understood that though the description herein generally refers to casement windows, the present invention could also be used with a variety of different window types, including wide awning windows and double-hung windows, as well as windows made of a variety of different materials, such as wood or vinyl wrap windows. Specifically, snubber 10 of the present invention may be advantageously used to prevent unwanted deflection and increase the effectiveness of the seal between sash and frame of a variety of types of windows when in the closed position.

Snubber 10, which will hereafter be described, is only one example of the type of snubber which would benefit from incorporating the present invention and method. Though a particular snubber structure such as disclosed herein may be advantageously used with the present invention, once a full understanding of the present invention is obtained, it should be recognized that still other snubber configurations could also be advantageously used with the present invention.

Referring to FIGS. 1-5, snubber 10 generally includes base 12 and flange 16, which may be integrally formed with base 12 and extends substantially upright therefrom. Snubber 10 is preferably made of metal, although other suitable materials are likewise contemplated by this disclosure. Apertures 14 are defined in base 12 on lateral sides of flange 16, and may be used for accommodating mounting fasteners (not depicted). Also, integrally formed within base 12 is slot 18 which, in the depicted embodiment, extends entirely through base 12. Slot 18 is disposed generally adjacent flange 16 and is configured such that slot edge 19 adjacent flange 16 corresponds with a line bisecting the holes defined by apertures 14. Slot 18 is at least as wide as flange 16 so as to accommodate a similar flange 16 from a like snubber 10. Preferably slot 18 is wider than flange 16 so that sufficient tolerance is provided for accommodating imprecisely mounted snubbers 10.

Flange 16 constitutes a protrusion with angled outer surface 20 that terminates in a hook 22 presenting contact surface 23. The inside engaging surface 24 of the flange 16 is somewhat concave in profile so that the hook 22 defines a laterally projecting lip 25. Further, the flange 16 generally protrudes from a raised portion 26 of the base 12 with interface surface 27 facing into slot 18. The shape and location of flange 16 enables it to be effectively used as a compression snubber within a pivoting casement window 1. When upper 5 and lower 6 hinge assemblies are cranked out to swing window 1 open, flanges 16 can easily rotate past one another. Therefore, opening the casement window is not inhibited by the snubbers.

Figure 5:
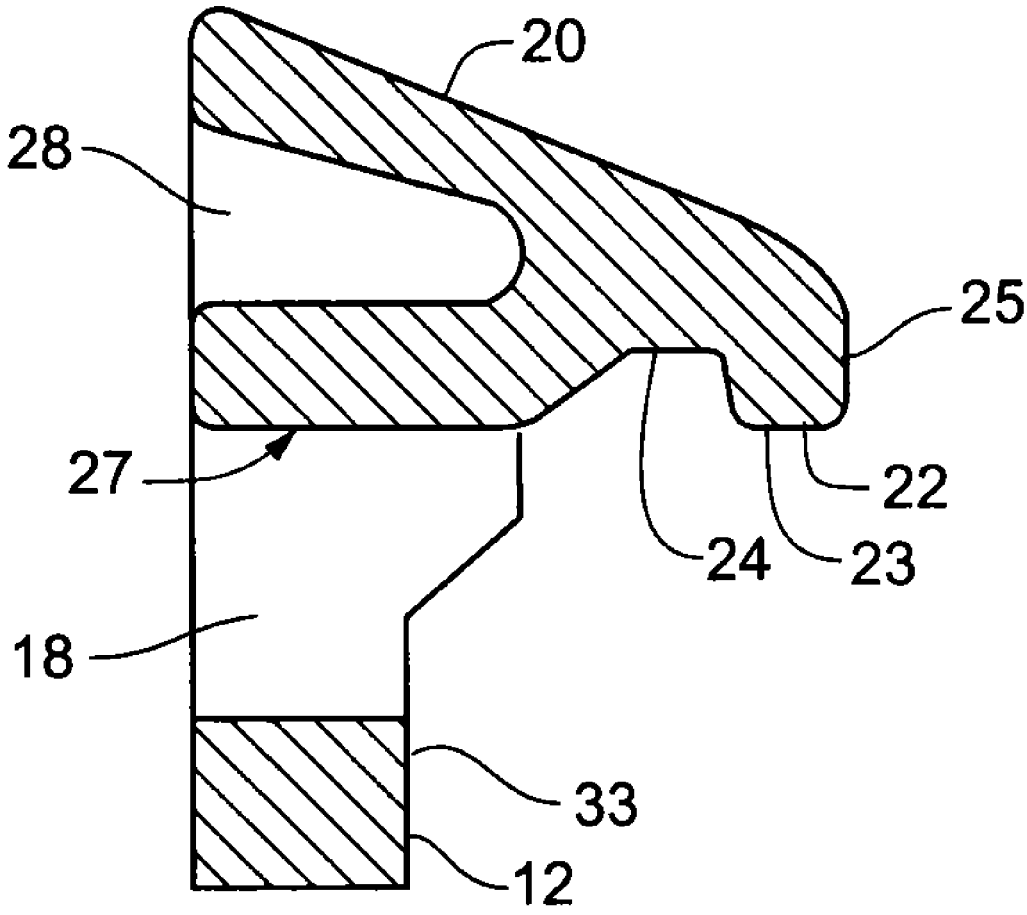
FIG. 5 is a side cross-sectional view of the snubber device of FIG. 1.

A cross-sectional profile of the snubber 10 is shown in FIG. 5. The general shape of the hook 22, contact surface 23, inside engaging surface 24, and interface surface 27 can be better understood. The location of slot 18 and recess 28 found behind flange 16 are shown as well. Recess 28 is used during the manufacturing process when forming the flange and base members.

Figure 6:
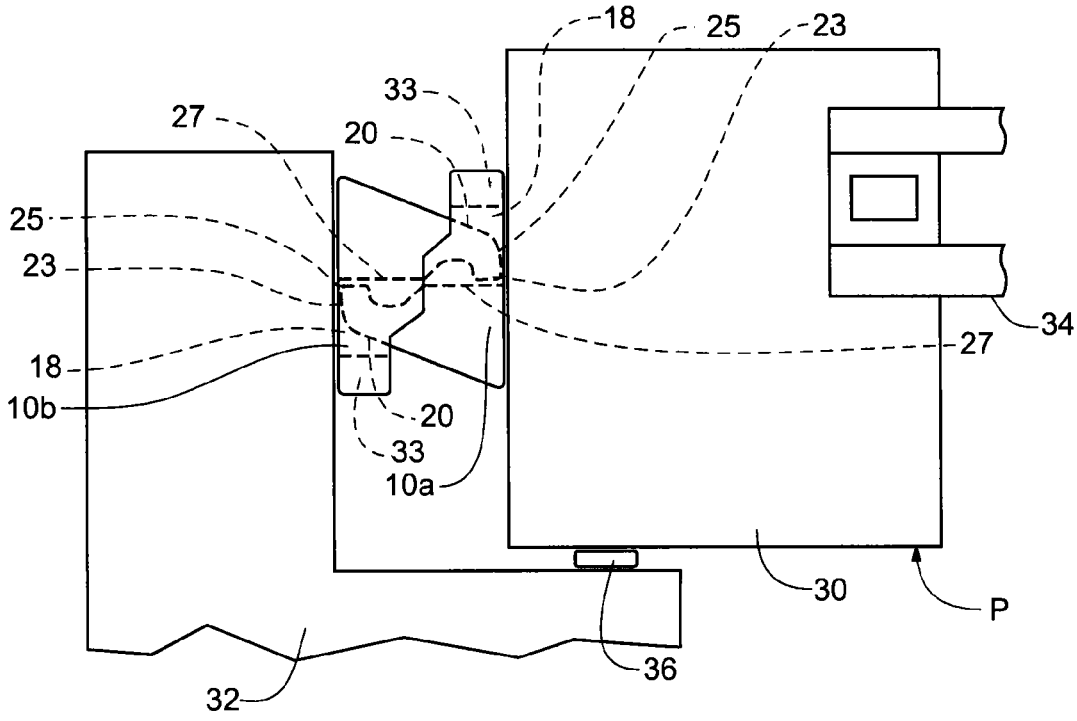
FIG. 6 depicts a casement window system with a pair of the snubber devices of FIG. 1 where the window is in a normal closed position.
Figure 7:
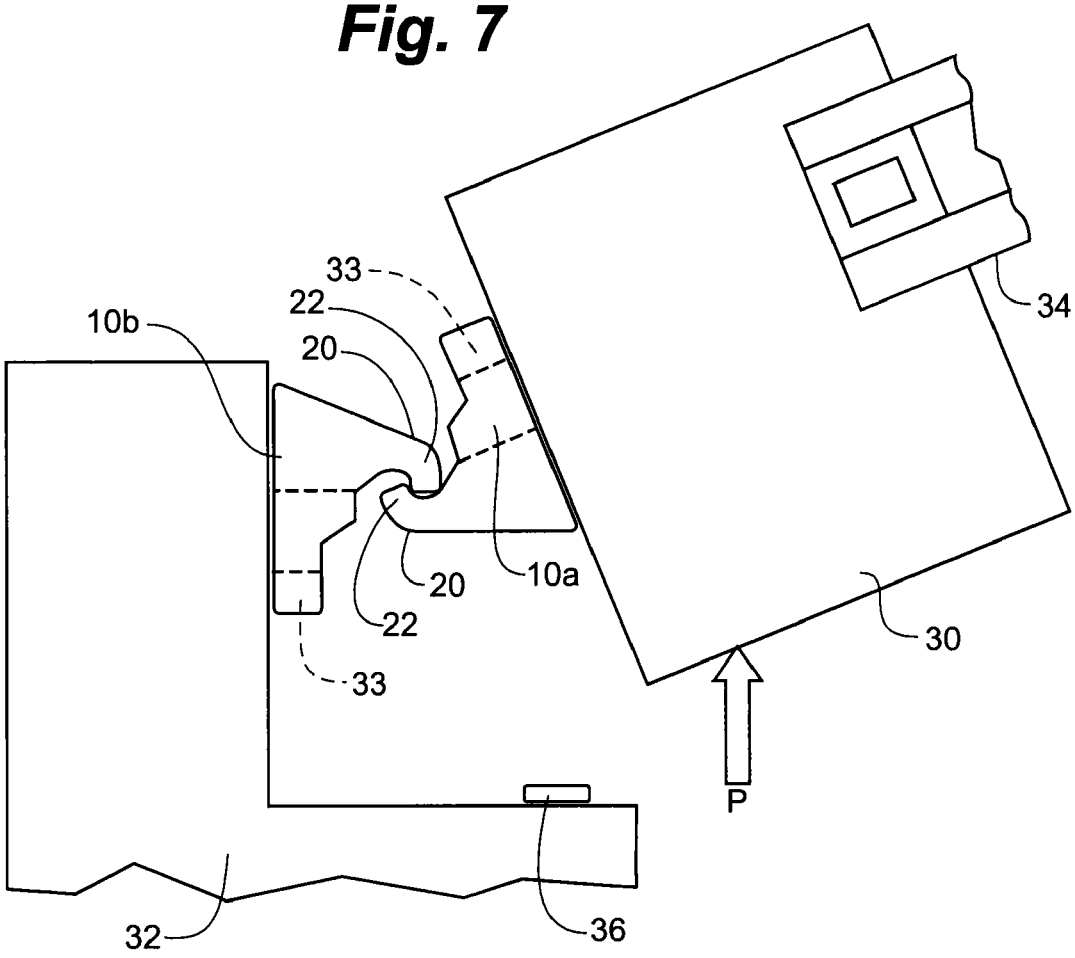
FIG. 7 depicts a casement window system with a pair of the snubber devices of FIG. 1 where high negative pressure is exerted on the sash.
Figure 8:
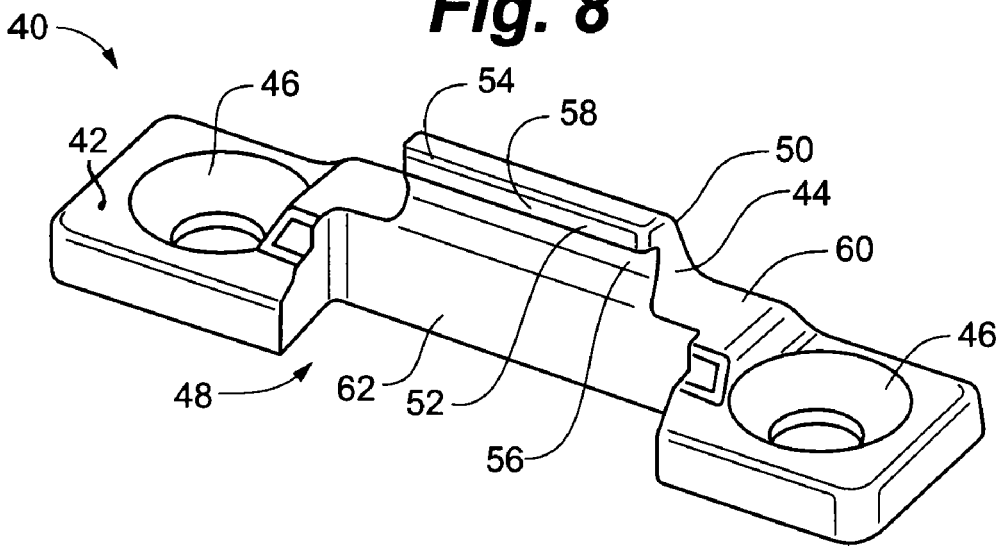
FIG. 8 is a perspective view of an alternative embodiment of a snubber device of the present disclosure.
Figure 9:
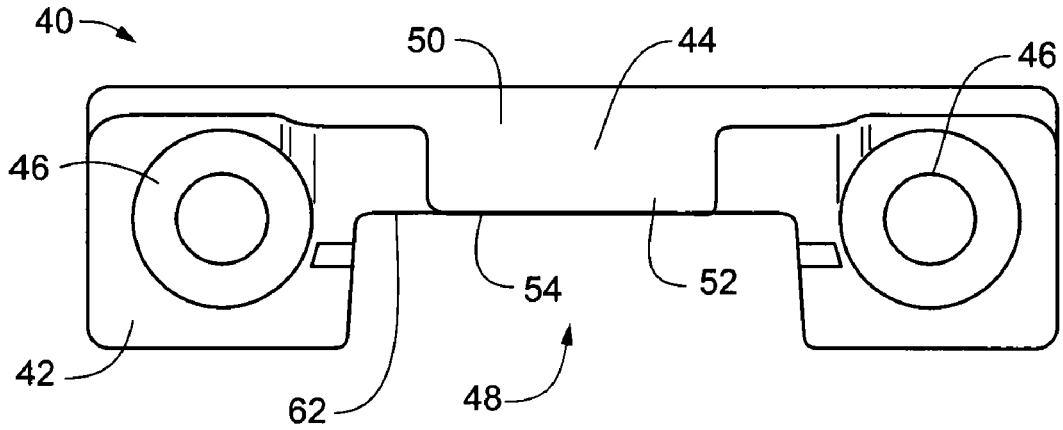
FIG. 9 is a top view of the snubber device of FIG. 8.
Figure 10:
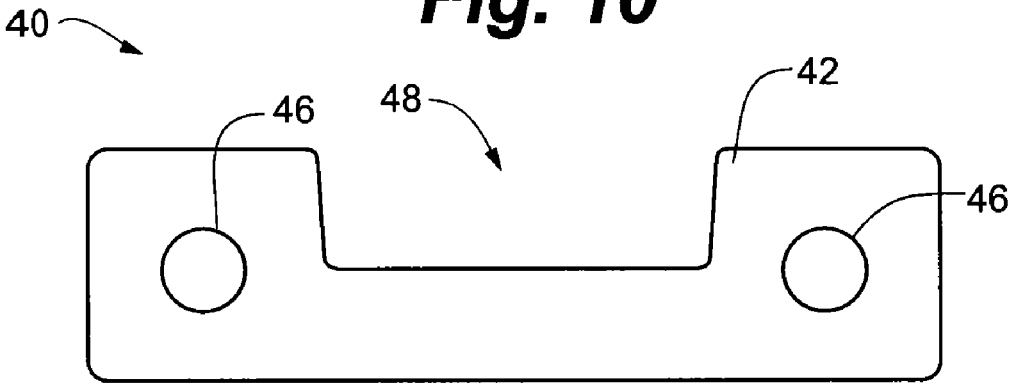
FIG. 10 is a bottom view of the snubber device of FIG. 8.

As depicted in FIGS. 6 and 7, a pair of snubbers 10*a*, 10*b*, according to embodiments of the invention can serve the functions of both compression and interlocking snubbers. Snubbers 10 (or 10*a* and 10*b*) may be configured to form an assembly for use on a sash 30 and a frame 32 of a casement window.

In FIG. 6, a side view is shown of two snubbers 10*a* and 10*b* in inverted relation to one another. Snubber 10*a* is mounted to sash 30 and snubber 10*b* is mounted to frame 32. In FIG. 6, window 34 is in a normal closed configuration. Because of the arrangement of snubbers 10*a*, 10*b*, and their features, contact surface 23 of snubber 10*a* engages the interface surface 27 of snubber 10*b* with flange 16 of snubber 10*a* received in slot 18 of snubber 10*b* and contact surface 23 of snubber 10*b* engages the interface surface 27 of snubber 10*a* with flange 16 of snubber 10*b* received in slot 18 of snubber 10*a*. The engagement of these features inhibits any movement of sash 30 away from frame 32 due to negative air pressure P, and compresses sash 30 tight against weatherstrip 36 to inhibit air leakage in the space between sash 30 and frame 32. Moreover, as sash 30 is pivoted outward to open the window, angled outer surface 20 is configured so as to clear crossmember 33, thereby preventing any interference between snubbers 10*a*, 10*b*, in operation of the window.

FIG. 7 depicts the assembly under a significantly higher negative air pressure P applied to sash 30 such that sash 30 is deflecting significantly. Snubbers 10*a* and 10*b* have slid past each other and interlocking hooks 22 on snubbers 10*a*, 10*b*, have engaged to inhibit further deflection of sash 30. When the negative air pressure P is reduced, the deflection of sash 30 will decrease and snubbers 10*a*, 10*b*, will return to the configuration of FIG. 6 so long as sash 30 has not exceeded its elastic limit.

It will be appreciated that snubbers 10*a*, 10*b*, may be substantially identical structures, thereby allowing ease of manufacture and interchangeability. When use with a window having vinyl sash or frame components is contemplated, apertures 14 may advantageously be located so as to correspond to the location of hinge fastener attachment reinforcement in the vinyl extrusions, since the same extrusion profile is generally used for all members in the sash assembly and likewise all members in the frame assembly. Thus, the spacing of fastener holes 14 in the sash snubber 10*a* corresponds with the spacing of fastener holes in the hinge sash arm. Likewise, the spacing of fastener holes 14 in the frame snubber 10*b* corresponds with the spacing of fastener holes in the hinge track. The arrangement therefore provides an advantageous design for PVC windows that typically extrude screw bosses in specific locations as manufacturing will be simplified and associated costs will be saved.

An alternative embodiment of a snubber 40 according to an embodiment of the invention is depicted in FIGS. 8-12. Snubber 40 generally includes base 42 and flange 44, which may be integrally formed with base 42 and extends substantially upright therefrom. Apertures 46 are defined in base 42 on lateral sides of flange 44, and may be used for accommodating mounting fasteners (not depicted). In this embodiment, crossmember 33 of the embodiment of FIGS. 1-5 is omitted, and instead base 42 defines notch 48 adjacent flange 44.

Flange 44 constitutes a protrusion with angled outer surface 50 that terminates in hook 52 presenting contact surface 54. Inside engaging surface 56 of flange 44 is somewhat concave in profile so that hook 52 defines a laterally projecting lip 58. Further, flange 44 generally protrudes from raised portion 60 of base 42 with interface surface 62 facing into notch 48. The shape and location of flange 44 enables it to be effectively used as a compression snubber within a pivoting casement window 1. When upper 5 and lower 6 hinge assemblies are cranked out to swing window 1 open, flanges 44 can easily rotate past one another. Therefore, opening the casement window is not inhibited by the snubbers.

Figure 11:
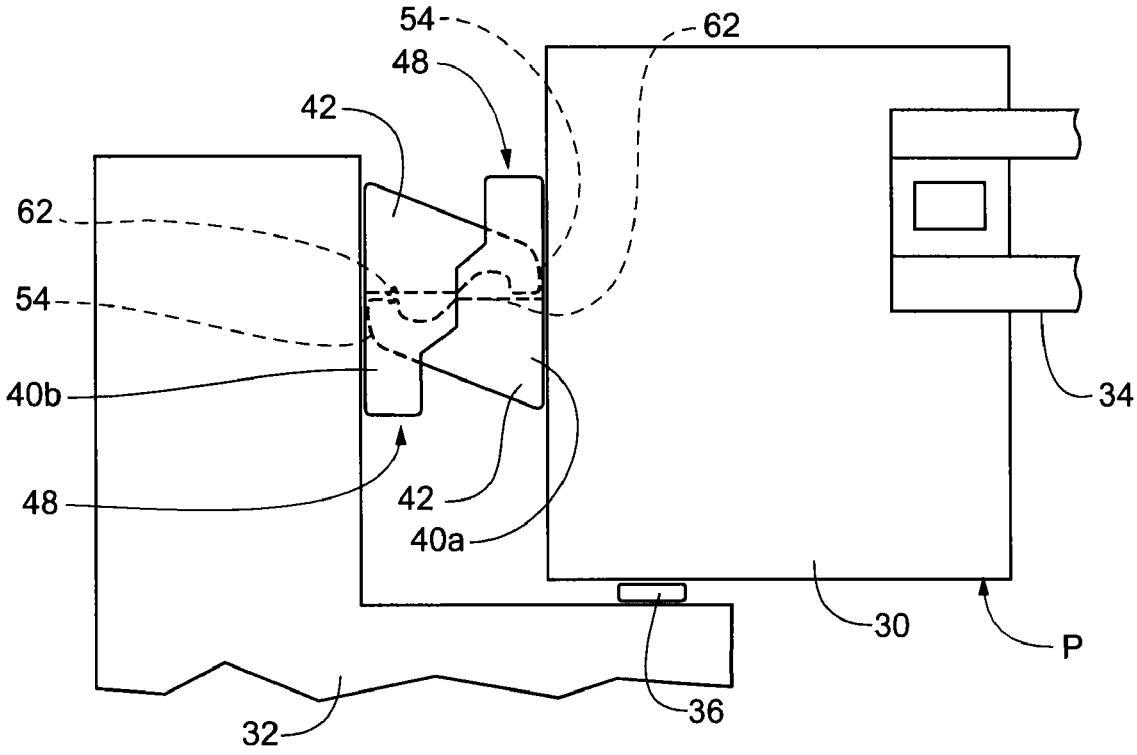
FIG. 11 depicts a casement window system with a pair of the snubber devices of FIG. 8 where the window is in a normal closed position.
Figure 12:
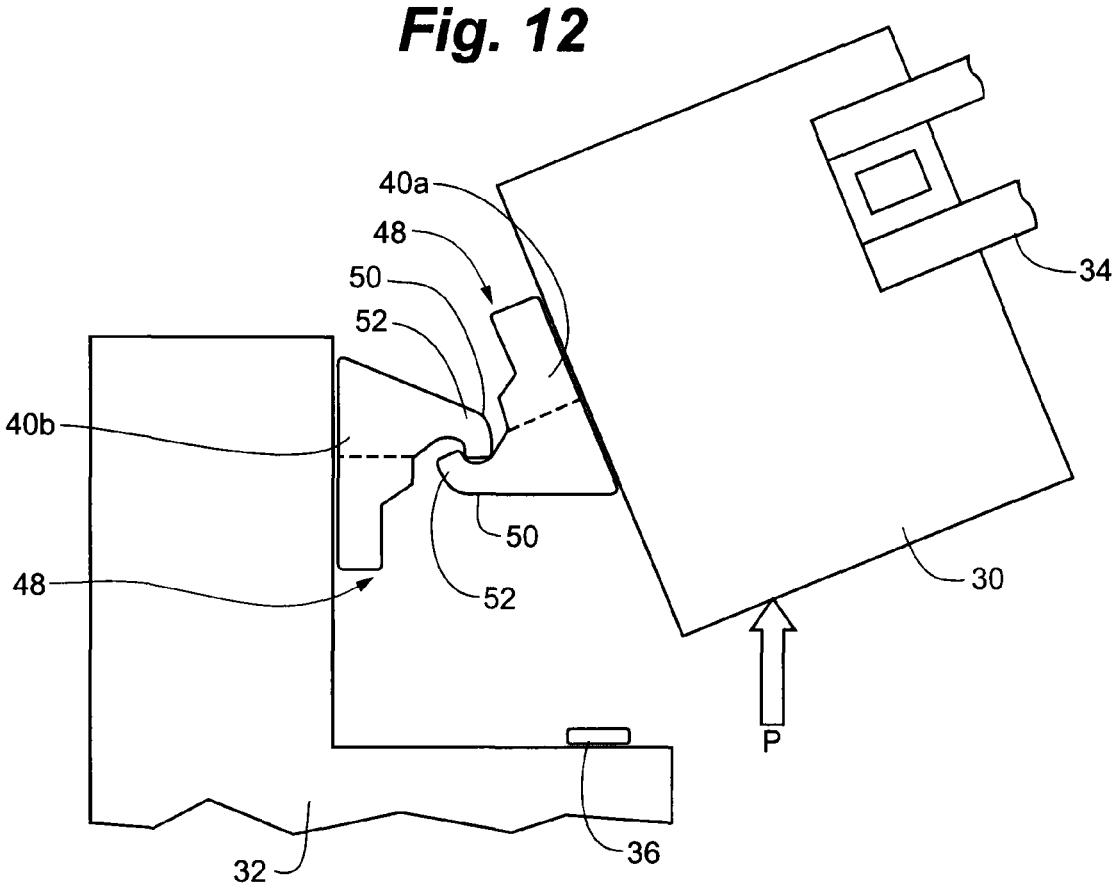
FIG. 12 depicts a casement window system with a pair of the snubber devices of FIG. 8 where high negative pressure is exerted on the sash.
Figure 13:
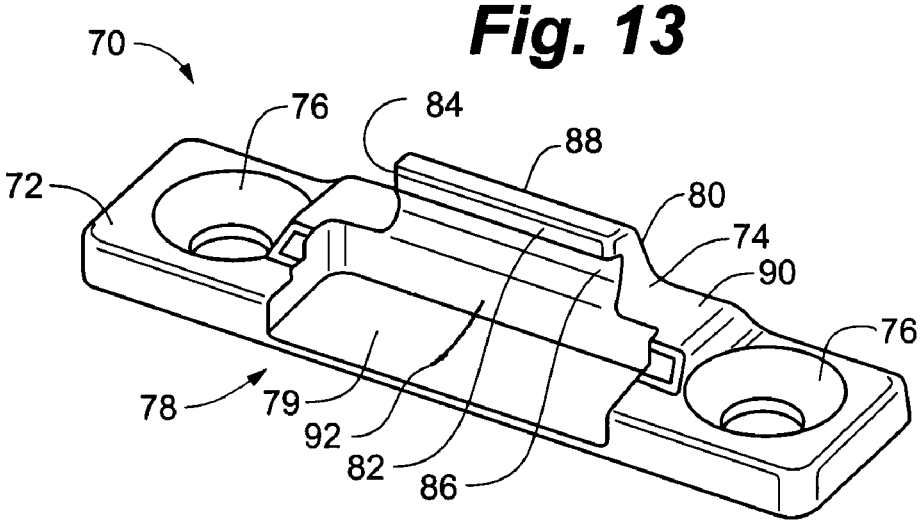
FIG. 13 is a perspective view of an alternative embodiment of a snubber device of the present disclosure.
Figure 14:
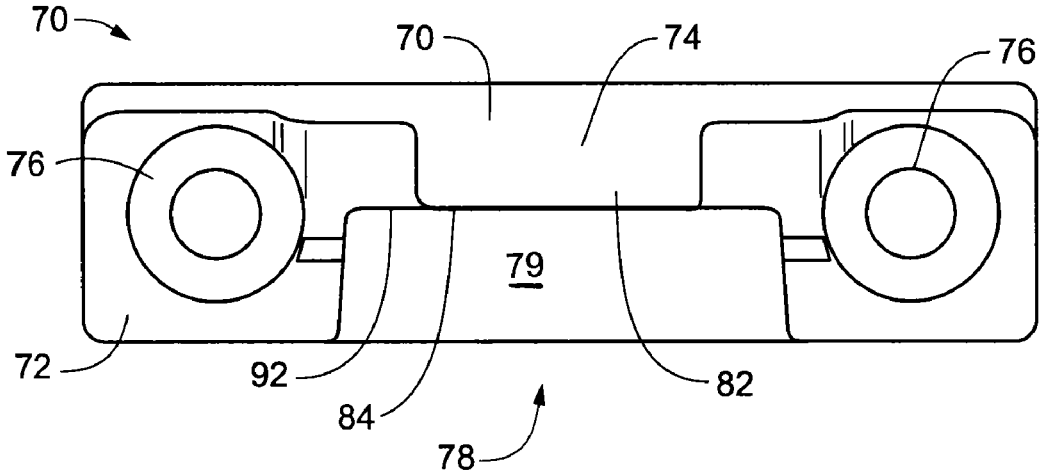
FIG. 14 is a top view of the snubber device of FIG. 13.
Figure 15:
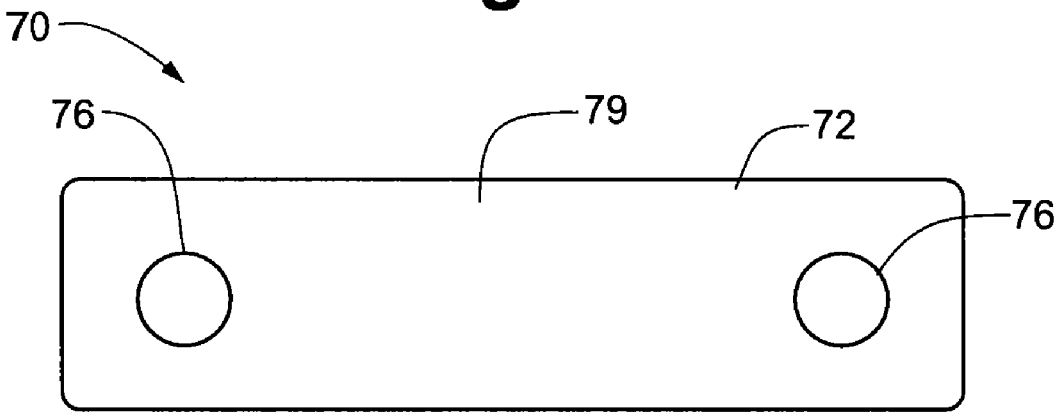
FIG. 15 is a bottom view of the snubber device of FIG. 13.

As depicted in FIGS. 11 and 12, the snubber 10 of the embodiment of FIGS. 8-12 operates substantially as the embodiment of FIGS. 1-5 in use. In a closed position of sash 30, contact surface 54 of a first snubber 40*a* engages the interface surface 62 of a second snubber 40*b* with flange 44 of snubber 40*a* received in notch 48 of snubber 40*b* and contact surface 54 of snubber 40*b* engages the interface surface 62 of snubber 40*a* with flange 44 of snubber 40*b* received in notch 48 of snubber 40*a*. As before, the engagement of these features inhibits any movement of sash 30 away from frame 32 due to negative air pressure P, and compresses sash 30 tight against weatherstrip 36 to inhibit air leakage in the space between sash 30 and frame 32. Moreover, as sash 30 is pivoted outward to open the window, notch 48 enables flange 44 of each snubber 40*a*, 40*b*, to shift away from base 42 of the other snubber, thereby preventing any interference between snubbers 40*a*, 40*b*, in operation of the window. FIG. 12 depicts the assembly under a significantly higher negative air pressure P applied to sash 30 such that sash 30 is deflecting significantly. Snubbers 40*a* and 40*b* have slid past each other and interlocking hooks 52 on snubbers 40*a*, 40*b*, have engaged to inhibit further deflection of sash 30. When the negative air pressure P is reduced, the deflection of sash 30 will decrease and snubbers 40*a*, 40*b*, will return to the configuration of FIG. 11 so long as sash 30 has not exceeded its elastic limit.

Another alternative embodiment of a snubber 70 according to an embodiment of the invention is depicted in FIGS. 13-17. Snubber 70 generally includes base 72 and flange 74, which may be integrally formed with base 72 and extends substantially upright therefrom. Apertures 76 are defined in base 72 on lateral sides of flange 74, and may be used for accommodating mounting fasteners (not depicted). In this embodiment, crossmember 33 of the embodiment of FIGS. 1-5 is omitted, and instead base 72 defines recess 78 with solid bottom 79 adjacent flange 74.

Flange 74 constitutes a protrusion with angled outer surface 80 that terminates in hook 82 presenting contact surface 84. Inside engaging surface 86 of flange 84 is somewhat concave in profile so that hook 82 defines a laterally projecting lip 88. Further, flange 74 generally protrudes from raised portion 90 of base 72 with interface surface 92 facing into recess 78. The shape and location of flange 74 enables it to be effectively used as a compression snubber within a pivoting casement window 1. When upper 5 and lower 6 hinge assemblies are cranked out to swing window 1 open, flanges 74 can easily rotate past one another. Therefore, opening the casement window is not inhibited by the snubbers.

Figure 16:
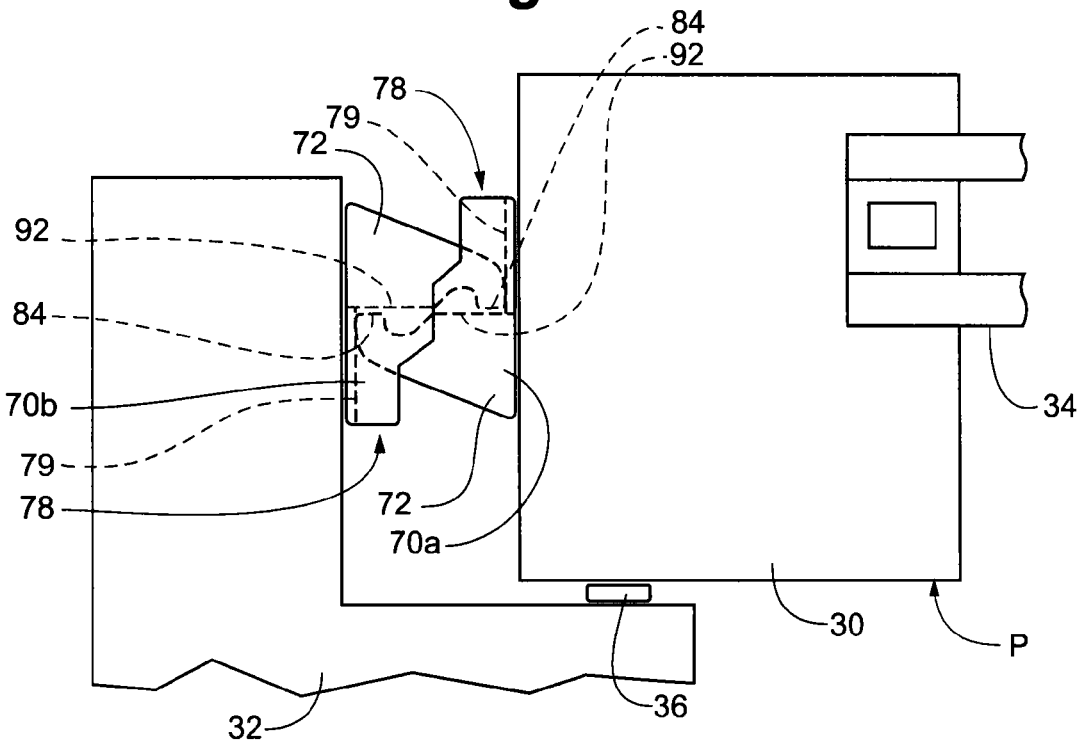
FIG. 16 depicts a casement window system with a pair of the snubber devices of FIG. 13 where the window is in a normal closed position.
Figure 17:
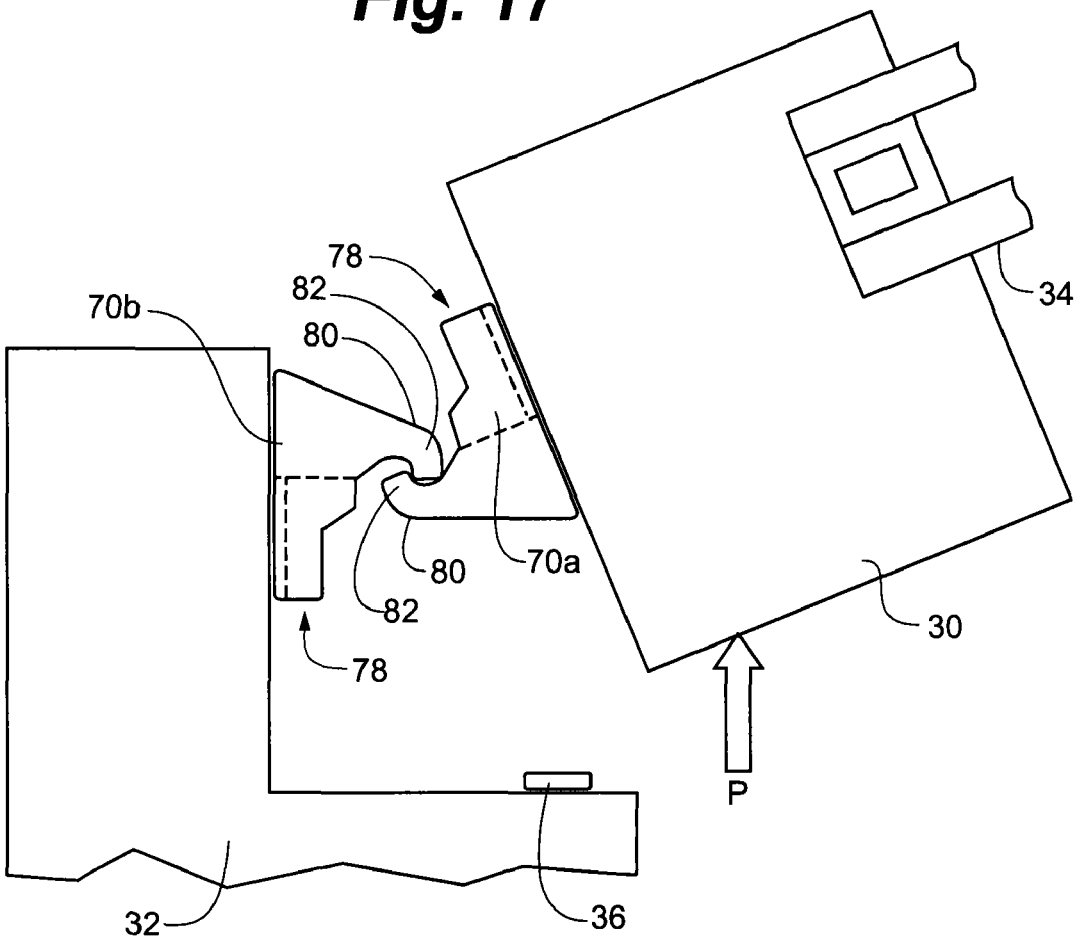
FIG. 17 depicts a casement window system with a pair of the snubber devices of FIG. 13 where high negative pressure is exerted on the sash.

As depicted in FIGS. 16 and 17, the snubber 70 of the embodiment of FIGS. 13-17 operates substantially as the embodiment of FIGS. 1-5 in use. In a closed position of sash 30, contact surface 84 of a first snubber 70*a* engages the interface surface 92 of a second snubber 70*b* with flange 74 of snubber 70*a* received in recess 78 of snubber 70*b* and contact surface 84 of snubber 70*b* engages the interface surface 92 of snubber 70*a* with flange 74 of snubber 70*b* received in recess 78 of snubber 70*a*. As before, the engagement of these features inhibits any movement of sash 30 away from frame 32 due to negative air pressure P, and compresses sash 30 tight against weatherstrip 36 to inhibit air leakage in the space between sash 30 and frame 32. Moreover, as sash 30 is pivoted outward to open the window, notch 78 enables flange 74 of each snubber 70*a*, 70*b*, to shift away from base 72 of the other snubber, thereby preventing any interference between snubbers 70*a*, 70*b*, in operation of the window. FIG. 17 depicts the assembly under a significantly higher negative air pressure P applied to sash 30 such that sash 30 is deflecting significantly. Snubbers 70*a* and 80*b* have slid past each other and interlocking hooks 82 on snubbers 70*a*, 70*b*, have engaged to inhibit further deflection of sash 30. When the negative air pressure P is reduced, the deflection of sash 30 will decrease and snubbers 70*a*, 70*b*, will return to the configuration of FIG. 16 so long as sash 30 has not exceeded its elastic limit.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A casement window comprising:

a frame defining an opening;

a sash operably coupled with and disposed in the frame, the sash selectively positionable between a closed position in which the sash closes the opening defined by the frame and an open position; and a snubber assembly for resisting deflection of the window sash in the frame when the sash is in the closed position, the snubber assembly comprising:

a pair of snubbers, each snubber having a base portion and a hook-shaped flange extending from the base portion, the base having a mounting surface for engaging the sash or the frame and further presenting a generally planar interface surface oriented substantially perpendicular to the mounting surface, the flange presenting a generally planar contact surface on a tip thereof, the contact surface being oriented in substantially the same plane as the interface surface;

wherein one of the pair of snubbers is mounted to the frame with the mounting surface engaging the frame and the other of the pair of snubbers is mounted to the sash with the mounting surface engaging the sash, the snubbers disposed such that when the sash is in the closed position, the contact surface of the hook-shaped flange of each snubber engages the interface surface of the other snubber, and wherein the hook-shaped flanges of the snubbers are adapted for releasable engagement when negative pressure is applied to the window sash.

2. The casement window of claim 1, wherein each snubber defines at least one mounting aperture for receiving a fastener to attach the snubber to the sash or the frame.

3. The casement window of claim 1, wherein the snubbers are made of metal.

4. The casement window of claim 1, wherein the contact surface of the flange is generally parallel with the interface surface.

5. The casement window of claim 1, wherein the base defines a slot aperture, and wherein the interface surface faces into the slot aperture.

6. The casement window of claim 1, wherein the base defines a notch in a periphery thereof, and wherein the interface surface faces into the notch.

7. The casement window of claim 1, wherein the base defines a recess therein, and wherein the interface surface faces into the recess.

8. A window snubber assembly for resisting deflection of a window sash in a window frame when the sash is in a closed position, the assembly comprising:

a first snubber member including a base and a flange portion, the base having features for attachment to the window frame and a mounting surface for engaging the window frame, the base defining a slot for receiving the flange portion of another snubber member, the flange portion integral with the base and extending substantially upright from the base, the flange portion terminating in a hooked end presenting a generally planar contact surface, the base presenting a generally planar interface surface facing into the slot and oriented perpendicular to the mounting surface, the contact surface being substantially co-planar with the interface surface;

a second snubber member including a base and a flange portion, the base having features for attachment to the window sash and a mounting surface for engaging the window frame, the base defining a slot for receiving the flange portion of another snubber member, the flange portion integral with the base and extending substantially upright from the base, the flange portion terminating in a hooked end presenting a generally planar contact surface, the base presenting a generally planar interface surface facing into the slot and oriented perpendicular to the mounting surface, the contact surface being substantially co-planar with the interface surface;

wherein the contact surface of the first snubber engages the interface surface of the second snubber when the flange portion of the first snubber is received in the slot of the second snubber, wherein the contact surface of the second snubber engages the interface surface of the first snubber when the flange portion of the second snubber is received in the slot of the first snubber, and wherein the hooked end portions of the flange portions of the first and second snubbers are cooperatively shaped so as to enable hooked engagement of the first and second snubbers as the window sash deflects in the window frame.

9. The window snubber assembly of claim 8 in combination with a casement window.

* * * * *